US005142720A

United States Patent [19]

Kelso et al.

[11] Patent Number: 5,142,720

[45] Date of Patent: Sep. 1, 1992

[54] POSITIONING DEVICE AND METHOD

[75] Inventors: Jimmie J. Kelso; Russell M. Hustead, both of Olathe; Walter T. Miller, Leawood, all of Kans.

[73] Assignee: Kansas Creative Device, Inc., Leawood, Kans.

[21] Appl. No.: 733,428

[22] Filed: Jul. 22, 1991

[51] Int. Cl.[5] ..... A61G 7/06

[52] U.S. Cl. ..... 5/630; 5/453; 5/648

[58] Field of Search ..... 5/61, 453, 630, 632, 5/648, 652, 657, 487

[56] References Cited

U.S. PATENT DOCUMENTS 3,477,071 11/1969 Emerson ..... 5/61
3,485,240 12/1969 Fountain ..... 5/61 X
3,646,624 3/1972 Zipf, III ..... 5/487 X
3,775,781 12/1973 Bruno et al. ..... 5/61
3,895,403 7/1975 Davis ..... 5/61 X
3,935,604 2/1976 Collins ..... 5/90
4,551,874 11/1985 Matsumura et al. .
4,627,122 12/1986 Hopp ..... 5/487 X
4,697,290 10/1987 Acklind et al. .
4,788,730 12/1988 Bexton .
4,864,671 9/1989 Evans .
4,947,500 8/1990 Seiler .
4,962,553 10/1990 Marquis .
4,977,629 12/1990 Jones ..... 5/61

*Primary Examiner*—Michael F. Trettel
*Attorney, Agent, or Firm*—Litman, McMahon & Brown

[57] ABSTRACT

A positioning device comprises a flexible sterilizable mat for wrapping across and tucking under a pad on an underlying supporting structure; a pair of opposing elevators, each having an inflatable compartment and an inboard seam connected to the mat near the center thereof; and a remotely controlled air supply and delivery system for selectively and separately inflating and deflating the elevators.

14 Claims, 2 Drawing Sheets

POSITIONING DEVICE AND METHOD

BACKGROUND OF THE INVENTION

The present invention relates to a device for positioning a human or an animal lying or sitting on a supporting structure and, specifically, to such a device for selective pelvic elevation and rotation for lateral uterine displacement of an expectant mother during labor and delivery.

proper maternal position during the course of labor and delivery promotes fetal circulation and well being when an expectant mother lies flat on her back in a supine position, she potentially could develop a malady sometimes referred to as supine hypotensive syndrome. That condition arises due to the fact that her blood pressure is lowered when the gravid uterus compresses the thin-walled inferior vena cava, which is the major blood vessel returning blood from her legs to her heart. If compression of the vena cava is sufficient, her heart will be deprived of an adequate supply of blood. As a result, significant hypotension will develop which, in turn, will decrease perfusion in her uterine artery and, hence, to her placental circulation.

Hypotension is most commonly measured in the brachial artery. If such blood deprivation does not cause hypotension to measurably develop in the brachial artery, blood pressure and perfusion to the uterus may still be reduced due to compression of the aorta by the enlarged uterus. Expectant mothers, who receive epidural or spinal anesthesia during labor or delivery, are particularly sensitive to hypotension because their blood pressure is generally depressed by application of the anesthesia.

Common obstetrical practice suggests encouraging an expectant mother in labor to lie on her side in order to remove the compressive effects of the uterus from her inferior vena cava and aorta. If the expectant mother prefers a more supine position, a foam wedge or rolled up towels or blanket are generally placed under one of her hips to avoid development of hypotension and fetal distress. Such a wedge or other device is usually placed under the right hip in order to displace her uterus laterally toward her left side since her easily compressible vena cava lies along the right side of her abdomen.

Since pelvic examinations and vaginal delivery are routinely conducted in a supine position, it may be necessary for the expectant mother to assume a supine or near-supine position at certain times during labor and delivery. Also, while administering an epidural anesthesia, it is essential that the expectant mother not lie on her side due to the fact that her block might otherwise become unilateral.

To further complicate matters, it is not uncommon for an expectant mother to be inadequately anesthetized on one side during the course of labor when utilizing epidural anesthesia. Such anesthetic inequality can sometimes be alleviated by positioning the expectant mother towards the side exhibiting greater pain by appropriately placing a foam wedge under one of her hips. This approach relies on gravity to help promote anesthetic flow toward her lower side and, thereby, to enhance the block in her previously inadequately anesthetized side.

In addition, for a cesarian section, a procedure which currently accounts for a substantial percentage of deliveries, the accepted practice is to initiate the operative incision with the expectant mother's hips tilted laterally by a foam wedge placed under one of her hips. After the baby has been delivered, a medical assistant then removes the wedge so the closing procedure will be mechanically simpler and less awkward. The added activity of removing the wedge, however, constitutes unnecessary intrusion in or near the sterile field and, further, unnecessarily inconveniences the attending surgeon. In addition, repeated use of the same device may lead to the spread of infectious disease, AIDS and the like.

What is needed is a device which can be easily and rapidly used to selectively elevate one of an expectant mother's hip during labor and delivery, such that the expectant mother is rotated into or out of a supine position, without unduly intruding into the sterile field and without interfering with or inconveniencing the attending surgeon or obstetrician.

SUMMARY OF THE INVENTION

A positioning device and a method are provided to elevate one hip above the other hip of a human being lying face-up on a supporting structure, such as an expectant mother during labor and delivery to prevent the compressive effects of her gravid uterus from interfering with proper functioning of her vena cava and aorta.

The device includes a flexible, sterilizable (if required for a particular application) sheet-like mat wrapped across and tucked under a pad on a supporting structure, such as an operating table or labor/delivery bed or the like, and also includes a pair of opposing inflatable elevators, each having an inboard edge connected to the mat near the center thereof. The device is spaced on the supporting structure such that the expectant mother lying on the supporting structure will have each of her hips juxtaposed on a different one of the elevators.

A remotely controlled air source in combination with an air delivery system in flow communication with each of the elevators provides for selective and separate inflation and deflation of the elevators such that one of the expectant mother's hips is elevated above her other hip, thereby providing lateral uterine displacement.

OBJECTS AND ADVANTAGES OF THE INVENTION

Therefore, the objects and advantages of the present invention include: providing a device and a method for selectively elevating one hip of a reclining human, such as an expectant mother during labor and delivery; providing such a device and a method for selectively rotating an expectant mother's pelvic region during labor and delivery; providing such a device and a method which laterally displace an expectant mother's uterus selectively to the left or to the right as she is lying in a near-supine position; providing such a device and a method which selectively enhance epidural block of an expectant mother during labor and delivery; providing such a device and a method in order to minimize the potential for supine hypotensive syndrome of an expectant mother during labor and delivery; providing such a device and a method for minimizing undesired compression of the vena cava and aorta of an expectant mother during labor and delivery; providing such a device and a method which eliminate undue intrusion into the sterile field of an expectant mother during labor and delivery; providing such a device and a method which avoids the spreading of infectious diseases; providing such a device and a method which do not inconvenience or interfere with a surgeon or obstetrician during delivery of an expectant mother; and generally providing such a device which is relatively easy to operate efficiently and reliably, economical to manufacture and use, simple to maintain, and which generally performs the requirements of its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
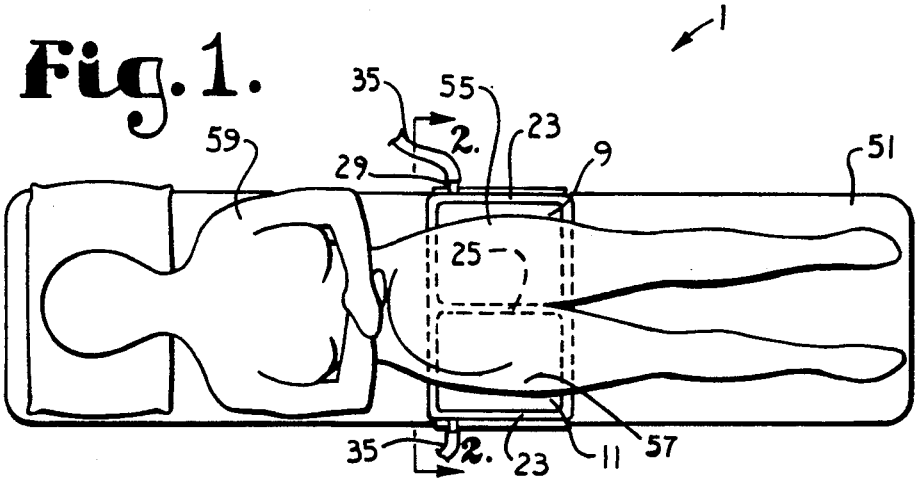
FIG. 1 is a fragmentary top plan view of a positioning device, according to the present invention, showing an expectant mother lying thereon.
Figure 2:
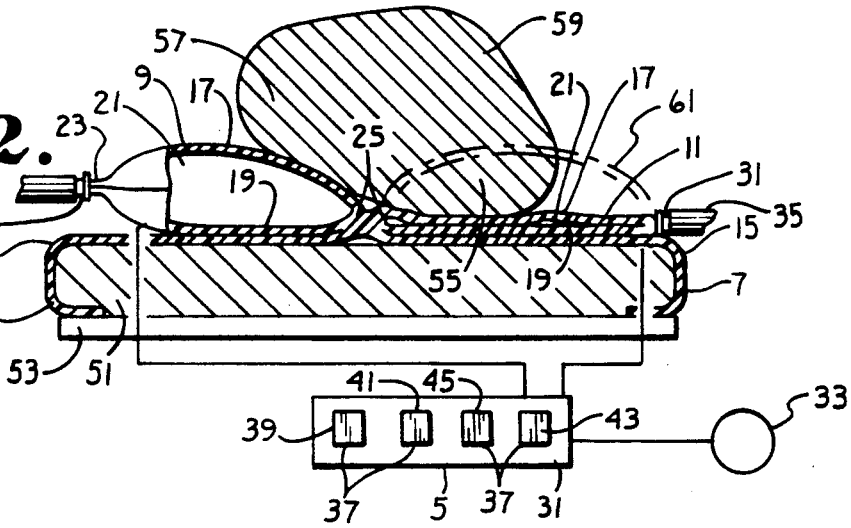
FIG. 2 is an enlarged, partially schematical, view of the positioning device, taken generally along line 2—2 of FIG. 1, with portions cut away to reveal details thereof, showing a left elevator inflated and a right elevator deflated.
Figure 3:
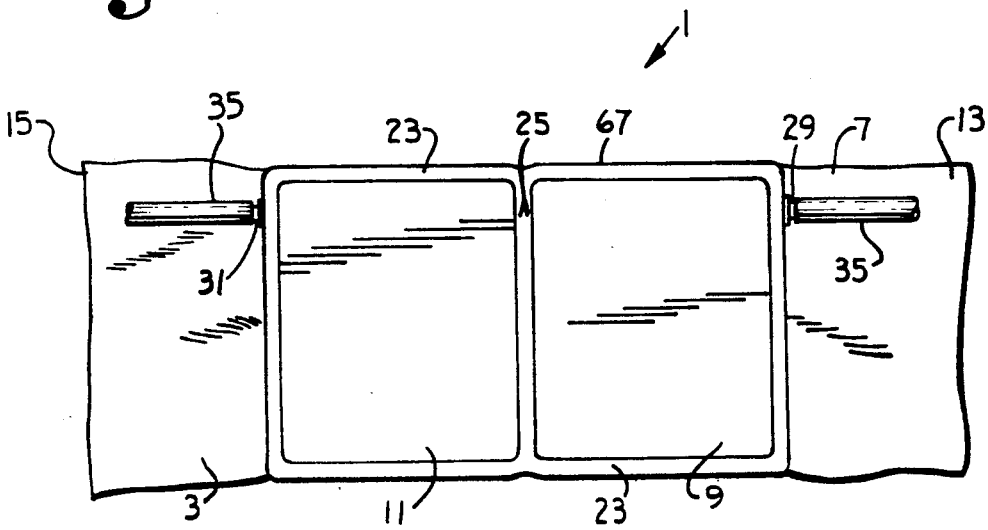
FIG. 3 is a schematic view of an inflate configuration for positioning device.

The reference numeral 1 generally refers to a positioning device in accordance with the present invention, as shown in FIGS. 1 to 3. The device includes an elongate mat 3 and remote inflation/deflation control means 5. The mat 3 is constructed of a relatively thin sheet 7 of flexible, sterilizable plastic or fabric-like material, such as polyvinylchloride, polyethylene or other suitable material. In one application of the present invention, the mat 3 is approximately 0.008 inch in thickness.

The mat 3 includes elevation means, such as a left elevator 9 and a right elevator 11, and securement means, such as a left anchor tab 13 and a right anchor tab 15 of the mat 3. Each of the elevators 9 and 11 has an outer wall 17 and an inner wall 19 enclosing an air-impenetrable compartment 21 therebetween and are substantially similar in size and shape. Preferably, the dimensions of the elevators 9 and 11 transverse to the mat 3 are approximately equal to the width of the mat 3. In one application of the present invention, the mat 3 has a width of approximately sixteen inches and a length of approximately fifty-six inches, and the elevators 9 and 11, in their deflated configuration, each has dimensions of approximately sixteen inches, transversely to the mat 3, by approximately ten inches along the length of the mat 3.

Each of the elevators 9 and 11 is constructed of flexible material generally having a sterilizable outer surface. For example, the elevators 9 and 11 may be constructed from sheet material by placing the outer wall 17 in abutting face-to-face relationship with the inner wall 19 and heat-welding, radio-frequency welding, or other suitable method, around the perimeters thereof as necessary, forming a seam 23 thereabout.

An inboard edge 25 of each of the elevators 9 and 11 is rigidly secured near the center of the mat 3, by heat-welding, radio-frequency welding, or other suitable method, such that the inboard edges 25 of each of the elevators 9 and 11 are substantially parallel to each other, as shown in FIG. 3, such that the anchor tabs 13 and 15 extend substantially outwardly beyond the respective elevators 9 and 11. In one application of the present invention, the anchor tabs 13 and 15 extend approximately eighteen inches beyond the elevators 9 and 11.

It is to be understood that the inboard edges 25 of each of the elevators 9 and 11 may, alternatively, be formed integrally, which could be the case if the elevators 9 and 11 are commonly formed from sheet material in abutting face-to-face relationship. Also, if desired, the elevators 9 and 11 may be sufficiently spaced apart to allow a baby's head to crown up or a baby to pass therebetween for an expectant mother giving birth in an upright position.

Figure 4:
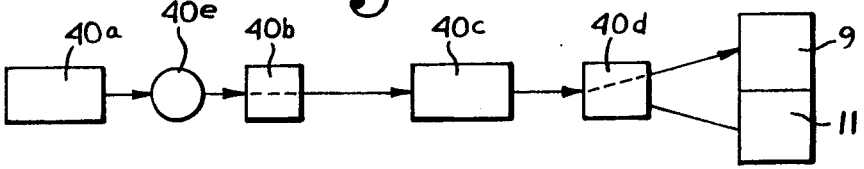
FIG. 4 is a schematic view of an inflate configuration for the left elevator of the positioning device.

A port 29 is connected to the left elevator 9 in flow communication with the compartment 21 therein. Similarly, a port 30 is connected to the right elevator 11 in flow communication with the compartment 21 therein. The control means 5, such as a hand-held control panel 31, in communication with a fluid source 33, nominally a gas provided by a compressor, pump, or other suitable source, causes a fluid, such as air, to be ducted to or from the elevators 9 and 11 by a plurality of valves (not shown) and delivery tubing 35 by methods commonly known in the art, and as schematically shown in FIGS. 2 and 4. (It is to be understood that the source 33 and the control means 5 may be combined into a single unit for some applications.)

For example, the control panel 31 can have a plurality of control buttons 37, as shown, such that each of the elevators 9 and 11 can be selectively and separately inflated or deflated as desired as hereinafter described. One of the buttons 37, such as that designated by the numeral 39, is depressed to activate the source 33 such as a pump **40*a*, activate a solenoidally driven valve 40*b* to an inflate configuration, activate a pressure regulating auto-sensor 40*c*, and activate another solenoidally driven valve 40*d* to a left inflate configuration, as shown in FIG. 4, such that fluid is delivered from the source 33 into the compartment 21 of the left elevator 9, thereby inflating or further inflating the left elevator 9**.

A Check valve **40*e* prevents backflow of the fluid. The auto-sensor 40*c* automatically deactivates the pump 40*a* at the desired pressure to prevent over-inflation of the elevators 9 and 11**. In one application of the present invention, a maximum pressure of 3-5 lbs. per square inch was sufficient to perform the requirements of its intended purpose.

Figure 5:
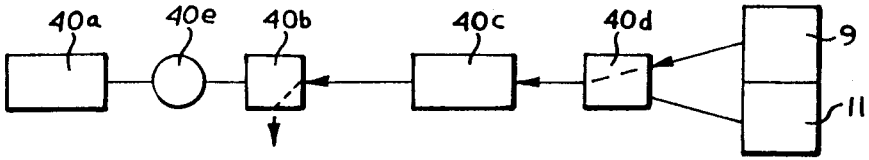
FIG. 5 is a schematic view of a deflate configuration for the left elevator, of the positioning device.

Similarly, depression of another one of the buttons 37, such as that designated by the numeral 41, deactivates the auto-sensor 40*c* and activates the valve 40*b* to a deflate configuration as shown in FIG. 5, such that gas is bled from the compartment 21 of the left elevator 9 into the ambient atmosphere, thereby deflating the left elevator 9.

Figure 6:
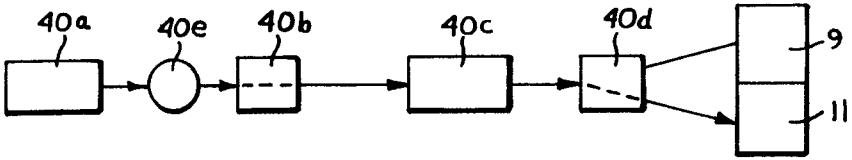
FIG. 6 is a schematic view of an inflate configuration for the right elevator of the positioning device.
Figure 7:
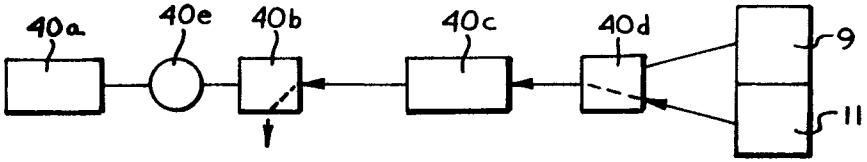
FIG. 7 is a schematic view of a deflate configuration for the right elevator of the positioning device, according to the present invention.

Another one of the buttons 37, such as that designated by the numeral 43, can similarly be used to activate the pump 40*a*, the valve 40*b*, the auto-sensor 40*c* and to additionally activate the valve 40*d* to a right inflate configuration as shown in FIG. 6, such that fluid is delivered from the source 33 into the compartment 21 of the right elevator 11, thereby inflating or further inflating the right elevator 11. The button 41 can also be used to bleed gas from the compartment 21 of the right elevator 11, as shown in FIG. 7, thereby deflating the right elevator 11. Another one of the buttons 37, such as that designated by the numeral 45, can be used to halt inflation of the left elevator 9 on the right elevator 11 before either of them is fully inflated, if desired.

It is to be understood that the ports 29 and 30 and the interconnections between the control means 5, the elevators 9 and 11, and the fluid source 33 can assume a multitude of different configurations and still obtain the desired result as described herein. For example, the buttons 37 may directly open and close the indicated valves or the buttons 37 may be switches in electrical communication with a remote set of valves (not shown) which direct gas to or away from the elevators 9 and 11, such that the elevators 9 and 11 are selectively and separately inflated or deflated as desired Alternatively, the control panel 31 may be interconnected wirelessly to the elevators 9 and 11, and the fluid source 33, or, the control panel 31 may be foot-controlled.

In an application of the present invention, the mat 3 is placed across a pad or mattress 51 supported by a bed or gurney 53, or other supporting structure. The mat 3 is spaced on the gurney 53 such that a left hip 55 and a right hip 57 of an expectant mother 59 placed on the gurney 53 will be superimposed on and supported by the left elevator 9 and the right elevator 11, respectively, as shown in FIG. 1. The tabs 13 and 15 are wrapped around the mattress 51 such that the tabs 13 and 15 are frictionally secured between the mattress 51 and the gurney 53, particularly when the expectant mother 59 is placed on the gurney 53.

By leaving the right elevator 11 deflated by activating the appropriate button 37, the left elevator 9 is inflated such that the expectant mother's left hip 55 is elevated above her right hip 57, causing a laterally rightward uterine displacement of the expectant mother 59, as shown in solid lines in FIG. 2. If, instead, a laterally leftward uterine displacement is desired in order to reduce or eliminate compression of the expectant mother's vena cava or aorta by her gravid uterus during labor or delivery, only the right elevator 11 is inflated, as indicated by the phantom lines in FIG. 2 designated by the numeral 61. Another configuration of the present invention involves having both of the elevators 9 and 11 either deflated or equally, totally or partially, inflated such that the expectant mother 59 assumes a supine position for cesarian section closure, or the like.

If desired, the expectant mother 59 can be periodically rotated from one of her hips to the other hip in order to promote shifting of circulatory perfusion patterns and to alleviate localized fatigue and to promote an equal bilateral epidural block, either of which may develop from lying continuously in a given position for an extended period of time, such as during a lengthy labor or delivery. Such periodic rotation can be accomplished by deflating the inflated one of the elevators, 9 or 11, and inflating the deflated one of the elevators, 11 or 9, thereby easing some of the discomfort of the expectant mother 59.

The interconnections between the control panel 31, the elevators 9 and 11, and the fluid source 33 are generally configured such that the control means 5 can either be disposed for each access thereto by medical personnel or for easy access by the expectant mother 59 so that she can periodically alter the relative elevations of the elevators 9 and 11. Alternatively, the control means 5 can be wirelessly connected to remotely control the selective inflation and deflation of the elevators 9 and 11, thereby providing unhindered placement of the control means 5 as desired.

Alternatively, an inflatable support compartment (not shown) can be connected along an edge 67 of the mat 3 to provide some support to the small of the back of the expectant mother 59. In that event, such support compartment would be separately and individually inflatable and deflatable by another pair of controls (not shown), similar to the buttons 37 as hereinbefore described.

It is to be understood that the device 1 can be used for numerous applications, including episiotomy pain relief, thyroidectomy, oral surgery, lumbar laminectomy, etc., as well as for a multitude of procedures performed by veterinarians on animals.

It is anticipated that the device 1 can be sufficiently economically manufactured such that the device 1 can be discarded after each use thereof in order to avoid spreading of infectious diseases, AIDS and the like.

It is also to be understood that while certain forms of the present invention have been illustrated and described herein, it is not to be limited to the specific forms or arrangement of parts described and shown.

What is claimed and desired to be secured by Letters Patent is as follows:

1. A positioning device supported by a pad on a supporting structure, comprising:

(a) an elongate mat constructed of flexible, sheet-like, sterilizable material; said mat having a length sufficient to wrap across said pad and tuck between said pad and said supporting structure such that said mat is frictionally held in place; said mat having an upper surface;

(b) a pair of elevators, each one of said pair of elevators having a flexible, sterilizable outer surface; each one of said pair of elevators having an air-impenetrable compartment therein; each one of said pair of elevators being attached to said mat upper surface; each one of said pair of elevators having an inboard edge;

(c) control means for selectively and separately inflating and deflating each one of said pair of elevators; and (d) means for attaching said elevators to each other in proximity to said inboard edges thereof and to said mat upper surface generally medially thereof.

2. The positioning device of claim 1, wherein each one of said pair of elevators has an inboard edge; each of said pair of elevators is connected to said mat near the center of said mat; each of said pair of elevators is connected to said mat only along said inboard edge.

3. The positioning device of claim 1 wherein:

(a) said mat has a length of approximately fifty-six inches and a width of approximately sixteen inches.

4. The positioning device of claim 3 wherein:

(a) said mat is constructed of polyvinylchloride having a thickness of approximately 0.008 inch.

5. The positioning device of claim 1 wherein:

(a) each one of said pair of elevators has a first dimension, transversely to said mat, approximately equal to the width of said mat and a second dimension, along the length of said mat, approximately equal to one-half of the width of the supporting structure.

6. The positioning device of claim 5 wherein:

(a) said second dimension of each one of said pair of elevators is approximately ten inches.

7. The positioning device of claim 1 wherein:

(a) said control means include a first switch for selectively inflating a first one of said pair of elevators, a second switch for selectively inflating a second one of said pair of elevators, and a third switch for deflating said pair of elevators.

8. The positioning device of claim 7 wherein:

(a) said control means includes a pressure limiting mechanism such that overinflation of said elevators is eliminated.

9. The positioning device of claim 7 wherein:

(a) said switching means are activated by a foot.

10. The positioning device of claim 1 wherein:

(a) said control means are operated wirelessly.

11. A supine hypotensive syndrome avoidance device for use with an expectant mother lying on a pad supported by a supporting structure during labor and delivery, comprising:

(a) an elongate mat constructed of flexible, sheet-like, sterilizable material; said mat having sufficient length to wrap across the pad and tuck both ends of said mat between the pad and the supporting structure such that said mat is frictionally held in place on said pad; said mat spaced on the supporting structure such that the expectant mother's hips will be superimposed on said mat;

(b) a pair of elevators, each having a compartment therein; each one of said pair of elevators constructed of flexible material; each one of said pair of elevators has a sterilizable outer surface; each one of said pair of elevators has an inboard edge connected near the center of said mat; each said inboard edge has a length approximately equal to the lateral dimension of said mat whereat said inboard edge is connected to said mat;

(c) a pair of ports, each in flow communication with a different one of said compartments of said pair of elevators;

(d) an air source;

(e) an air delivery system including tubing interconnected between said air source and said pair of ports such that air is deliverable to said compartments;

(f) a remote control panel interconnected with said air delivery system such that each of said pair of elevators is separately and selectively inflatable and deflatable such that said device assumes:

(1) a first configuration wherein a first one of said pair of elevators is inflated and a second one of said pair of elevators is deflated providing laterally leftward uterine displacement of the expectant mother;

(2) a second configuration wherein said first one of said pair of elevators is deflated and said second one of said pair of elevators is inflated providing laterally rightward uterine displacement of the expectant mother; and (3) a third configuration wherein said pair of elevators are approximately equally inflated such that the expectant mother assumes a supine position; and (g) a pressure limiting mechanism such that overinflation of said pair of elevators is prevented.

12. A positioning device, comprising:

(a) an elongated mat constructed of flexible, sheet-like sterilizable material;

(b) a pair of elevators, each having a flexible, sterilizable outer surface; each one of said pair of elevators having an air-impenetrable compartment therein; each one of said pair of elevators has an inboard edge; each of said pair of elevators is connected to said mat near the center of said mat; each of said pair of elevators is connected to said mat only along said inboard edge; and (c) control means for selectively and separately inflating and deflating each one of said pair of elevators.

13. A method for selectively positioning a being, animal or human, comprising the steps of:

(a) providing:

(1) a pair of flexible opposing elevators, each having a sterilizable outer surface and an inflatable compartment; said elevators having a remotely controlled air source and delivery system in separate flow communication with each of said elevators;

(2) a pad supported by a supporting structure; and (3) an elongate mat constructed of flexible sheet-like material; said mat having sufficient length such that said mat is wrapped across and tucked between said pad and said supporting structure for frictional securement therebetween; said mat connected generally medially to an inboard edge of each of said elevators;

(b) placing the being on said elevators such that one of the being's hips is superimposed on one of said elevators and the other one of the being's hips is superimposed on the other one of said elevators; and (c) selectively and separately inflating and deflating said elevators such that one of the being's hips is positioned relative to the other one of the being's hips as desired.

14. A method for selectively positioning a being, animal or human, comprising the steps of:

(a) providing:

(1) a pad supported by a supporting structure;

(2) an elongate mat constructed of flexible, sheet-like sterilizable material; said mat having a length sufficient to wrap across said pad and tuck between said pad and said supporting structure such that said mat is frictionally held in place; said mat having an upper surface;

(3) a pair of elevators, each one of said elevators having a flexible, sterilizable outer surface; each one of said elevators having an air-impenetrable compartment therein; each one of said pair of elevators being attached to said mat upper surface; each one of said pair of elevators having an inboard edge;

(4) control means for selectively and separately inflating and deflating each one of said pair of elevators; and (5) means for attaching said elevators to each other in proximity to said inboard edges thereof and to said mat upper surface generally medially thereof;

(b) placing the being on said elevator such that one portion of the being's body is superimposed on one of said elevators and another portion of the being's body is superimposed on the other one of said elevators; and (c) selectively and separately inflating and deflating said elevators such that said one portion of the being's body is positioned relative to said other portion of the being's body as desired.

* * * * *